United States Patent [19]

Bushman et al.

[11] 4,279,729

[45] Jul. 21, 1981

[54] ANODE AND METHOD OF CONSTRUCTION

[75] Inventors: James B. Bushman, Medina; James R. Dimond, Burton; John Hennessy, Fairview Park, all of Ohio

[73] Assignee: Harco Corporation, Medina, Ohio

[21] Appl. No.: 140,013

[22] Filed: Apr. 14, 1980

Related U.S. Application Data

[63] Continuation of Ser. No. 11,188, Feb. 12, 1979.

[51] Int. Cl.[3] ..... C23F 13/00; C25B 11/00; H01R 43/00

[52] U.S. Cl. ..... 204/196; 29/857; 204/280

[58] Field of Search ..... 204/280, 286, 196, 284; 29/505, 525, 526 R, 628, 629, 630 A, 857, 858, 861

[56] References Cited

U.S. PATENT DOCUMENTS

| | | | |
|---|---|---|---|
| 2,876,190 | 3/1959 | Oliver | 204/196 |
| 2,926,128 | 2/1960 | Flower | 204/196 |
| 3,772,178 | 11/1973 | Wilson | 204/280 |

OTHER PUBLICATIONS

Bulletin DA/10a DURICHLOR 51 Type TA Tubular Anodes published by the Duriron Company Inc., Dayton, Ohio (2 pp.).

Bulletin published by Harco Corporation relating to LORESCO Center-Tapped Graphite Anodes Manufactured by Cathodic Engineering Equip. Co.

*Primary Examiner*—T. M. Tufariello

*Attorney, Agent, or Firm*—Maky, Renner, Otto & Boisselle

[57] ABSTRACT

An anode having an elongated body which may be extruded contains a bore extending at least partially through the body. The bore has an intermediate portion between the ends of the anode. A lead wire in the bore is fastened to a connector member having a self-tapping thread engageable at predetermined torque with the surface of the bore at the intermediate portion for cutting a thread in the bore upon relative rotation of the connector member and the body of anode material. A sealant is inserted in the bore after a thread is cut in the bore and surrounds the left in place connector member preventing moisture from reaching the connection to the anode at the intermediate portion.

52 Claims, 11 Drawing Figures

ANODE AND METHOD OF CONSTRUCTION

This is a continuation of application Ser. No. 011,188, filed Feb. 12, 1979.

This invention relates to the construction and method of making anodes for cathodic protection and especially to anodes where the connection is placed deep in the interior of the anode. By locating the connection at a position near the center of the anode, the corrosion consumption which tends to attack the anode sooner at the ends than between the ends, known as "end effect" or "pencilling", will not expose the connection to moisture which causes premature failure.

Heretofore a center-connected anode has been proposed having two half sections with abutting ends threaded over a connector to position the connector in the center of the anode. In another proposed construction, the bore of the anode was drilled with a threaded portion at or near the center so that a connector could subsequently be threaded in the anode.

These constructions have presented difficulties in sealing and protecting the connection where the anode is in sections and the seam at the center must be sealed without increasing the corrosion consumption in that area. Where the anode was not in sections, there is a problem in drilling a straight hole through an anode of from 36 to 150 inches (91 to 381 centimeters) in length. It has also been difficult to tap threads at the center to receive a threaded connector. It is then a problem to engage the threads deep in the bore without cross-threading or stripping which has resulted in a weak unsatisfactory connection.

The extrusion of the anode body has also not been considered feasible because the extruded body is usually slightly curved and this has presented problems particularly in long anodes in providing a bore with the features desired such as a good, strong, tight connection at the center portion, ease of manufacture and assembly.

It is, therefore, an object of this invention to provide an anode construction in which the connector member has a self-tapping thread for cutting a thread in the bore to make a connection at a center intermediate portion of the anode.

Another object is to provide anti-rotation surfaces on the connector member when the anode body or connector is being rotated to cut the thread in the bore.

A further object is to provide an anode bore with an enlarged diameter from one end to an intermediate portion of the anode.

A still further object is to provide a tapered self-tapping thread on the connector member for cutting a thread and making a strong tight connection with the anode body.

Another object is to provide an anode construction with an extruded one-piece body.

A further object is to provide a connector member configuration to limit the extent of the thread cut in the bore.

Another object is to provide a method of making an anode in which the anode body is made with a bore, a connector member with self-tapping threads is brought into engagement with the surface of the bore and the anode body is rotated relative to the connector member to cut threads in the bore and produce a good tight connection.

A further object is to provide a method in which the bore is reamed out from one end to an intermediate portion to provide an enlarged bore and shoulder for receiving the connector member.

A still further object is to provide a method in which the anode body is extruded with a hole through its elongate axis.

Another important object is to provide a method in which the relative rotation of the anode body and the connector member is stopped at a predetermined torque for providing both the desired predetermined length of thread cut in the bore and the desired electrical conductivity between the connector and body.

A further object is to provide a method in which the rotation of the anode body relative to the connector member is stopped by a non-threaded portion on the connector member.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

Figure 1:
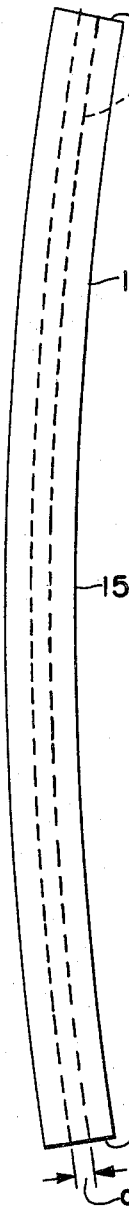
FIG. 1 is a side elevation of an extruded anode body prior to fabrication and assembly with other components of the anode embodying this invention.

Referring to FIG. 1, an anode body 10 for an anode suitable for cathodic protection is shown. The anode body 10 may be of a suitable anode material such as graphite and be extruded in tubular form with a bore 11 extending from a first end 12 to a second end 13. The anode body 10 may have a length of from 15 to 150 inches (38 to 381 centimeters) and be slightly curved as a result of the extrusion process. The curvature is shown somewhat exaggerated in FIG. 1. The bore 11 formed during the extrusion may have a diameter "d".

Figure 2:
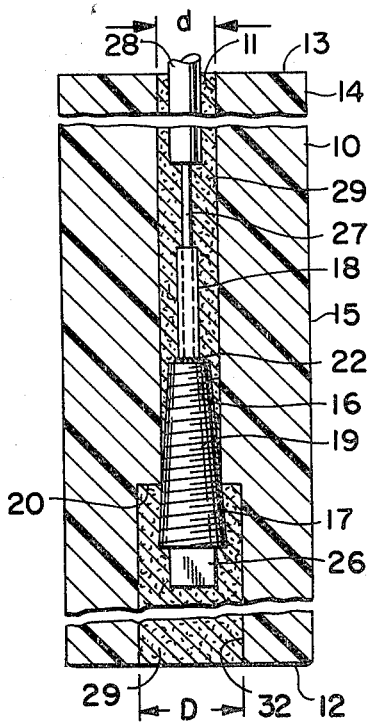
FIG. 2 is a longitudinal sectional view of the anode embodying the invention partially broken away.

Referring to FIG. 2, a sectional view of an anode 14 incorporating the anode body 10 is shown with the first end 12 and second end 13 broken away from a center intermediate section 15 having an intermediate portion 16 of the bore 11.

As shown in FIG. 2, the bore 11 is reamed from the first end 12 to the intermediate section 15 forming a distinct shoulder 20 at the approximate longitudinal center of the anode. After reaming, the bore from end 12 to the shoulder 20 has an enlarged diameter D through which a connector member 17 may be moved from such first end 12 to the intermediate section 15 of the anode body 10.

Figure 3:
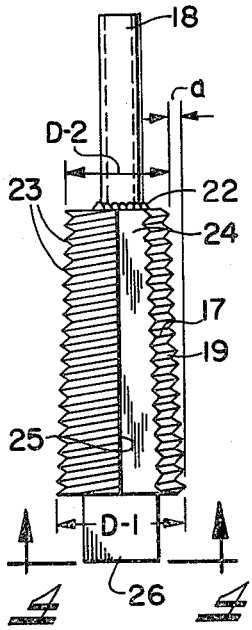
FIG. 3 is an enlarged detailed view of the connector shown in FIG. 2 turned about its axis to illustrate the flute for releasing the cut material.

As seen also in FIG. 3, the connector member 17 includes a sleeve 18 of copper or other suitable electrically conductive and malleable material and a truncated cone-shaped plug 19 of suitable bar stock or die cast material such as zinc or brass fastened to the sleeve 18 as by brazing or silver soldering at joint 22. As shown in greater detail in FIGS. 3 and 4, the plug is provided with self-tapping threads 23 and a flute 24 with a cutting face 25.

In the embodiment shown, the threads 23 have a 60° thread angle and a pitch of 0.1 inch (0.254 centimeters). The self-tapping threads 23 also are on a tapered surface of the plug 19 and have a taper angle "a" of approximately 3°. A square head 26 extends outwardly from the plug 19 and is engageable by a socket-type wrench or other tool for holding the connector member 17 during assembly of the anode 14. The anti-rotation head 26 shown is square; however, this may also be hexagonal or of other suitable configuration or in the form of a recess or socket as long as suitable anti-rotation surfaces are provided.

As shown in FIG. 2, the connector member 17 is positioned in the intermediate section 15 with the self-tapping threads 23 seated in threads cut in the surface of the intermediate portion 16 of the bore 11 at the shoulder 20 to provide a tight strong connection. A lead wire 27 extends from the second end 13 through the bore 11 to the connector member 17 where it enters the sleeve 18 and is held in the sleeve by crimping of the sleeve or other suitable swaging operation. The lead wire 27 may be covered with insulation 28. It is believed apparent that the lead wire is threaded first through the smaller then larger bores of the anode to be attached to the plug as indicated before the plug is inserted to form the threaded connection.

To seal the connector member 17 from moisture, a sealant 29 of suitable water-proofing material such as various low viscosity epoxy or asphaltic temperature or air setting materials is poured or injected into the bore 11 from the first end 12 and second end 13. A long proboscis tool may be employed in this regard.

Referring to FIGS. 2 and 3, the anode 14 is constructed so that the connector member 17 may be inserted into the enlarged portion 32 of the bore because the enlarged diameter D of the bore is greater than the maximum diameter D1 of the connector member 17. At the same time the enlarged diameter D is greater than the smaller diameter "d" of the bore 11 in the intermediate portion 16 so that the self-tapping threads 23 will engage the surface of the bore at the shoulder 20. The minimum diameter D2 of the self-tapping threads 23 is less than the diameter "d" of the bore 11 at the intermediate portion 16 so that the plug 19 may project into the bore 11 and be positioned partly in both bores at the shoulder following the tapping operation.

Referring to FIGS. 1–4, the method of making the anode 14 includes forming the anode body 10 with the longitudinal axis bore 11. This may be done by extruding the anode body 10 through a die into a configuration shown in FIG. 1. The enlarged portion 32 of the bore 11 is provided by reaming the bore from the end 12 to the intermediate section 15 which is the approximate center of the anode body 10. If desired, a pilot may be mounted on the reaming tool to follow the bore 11 and keep the enlarged portion 32 centered with respect to the anode body 10. The lead wire 27 is preferably threaded through the bore and then fastened to the connector member 17 by crimping the sleeve 18.

The connector is then inserted into the anode body 10 through the enlarged portion 32 of the bore 11. A socket wrench or similar tool with a flexible extension for the longer anodes is engaged with the anti-rotation head 26 and the self-tapping threads 23 are urged into engagement with the surface of the bore 11 at the shoulder 20 in the intermediate portion 16. Relative rotation of the anode body 10 and connector member 17 is provided so that the cutting face 25 of the threads 23 are moved into cutting engagement with the surface of the intermediate portion 16 of the bore 11 to cut threads in the surface. This relative rotation may be provided with long anodes preferably by holding the connector member 17 stationary while the anode body 10 is rotated. The relative rotation is continued until the torque required reaches a predetermined amount. The torque may be determined with a conventional torque wrench such as a one which free-wheels at the set torque. This is correlated with the desired amount of thread cut in the surface of the intermediate portion 16 of bore 11 to provide a strong tight electrical connection, but not so tight as to cause fracture or disintegration of the anode body.

With the tapered self-tapping threads 23, it can be seen that the more the connector member 17 is turned relative to the anode body the deeper the threads will be cut. The torque required will also be greater. After the connection is made between the connector member 17 and anode body 10, the sealant 29 is inserted in the bore 11 from the ends 12 and 13 to surround the connector member.

Figure 5:
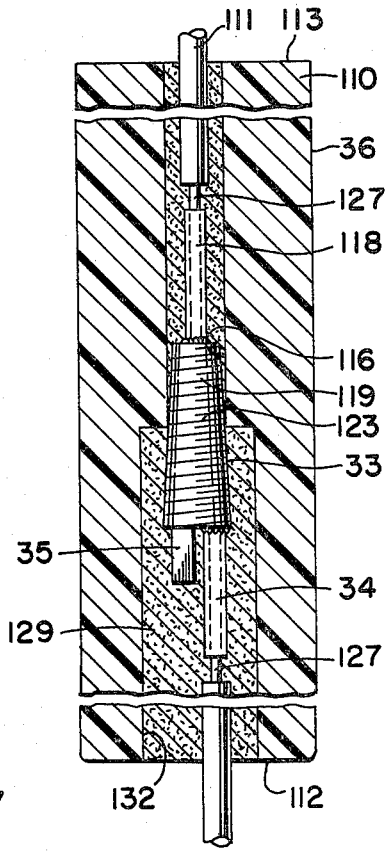
FIG. 5 is a view like FIG. 2 of a modification in which the lead extends through the anode from end-to-end and the anti-rotation surfaces of the connector are axially offset from the adjacent lead.

Referring to FIG. 5, a modification is shown in which the lead wire 127 extends through the anode body 110 from the first end 112 to the second end 113. The connector member 33 has a plug 119 and a sleeve 118 like the plug and sleeve shown in FIGS. 2 and 3; however, in addition the plug 119 has an additional sleeve 34 of metal such as copper which is crimped on the section of lead wire 127 extending through the enlarged portion 132 of the bore 111 from the first end 112. As shown in FIG. 5, the sleeve 34 is connected to the plug 119 by the braze or silver solder joint illustrated and is positioned adjacent but offset from an anti-rotation head 35 for engagement by a driving tool during the assembly of the anode 36. The precise configuration of the head and sleeve is shown more clearly in FIGS. 9–11. The method of making this anode 36 is the same as the method described hereinabove for the anode 14 of FIG. 2. The leads 127 will be connected to the connector before it is inserted for the tapping operation. After the self-tapping threads 123 cut the threads in the intermediate portion 116 of the bore 111, the space surrounding the connector member 127 in the bore 111 and enlarged portion 132 is filled with the sealant 129.

Figure 6:
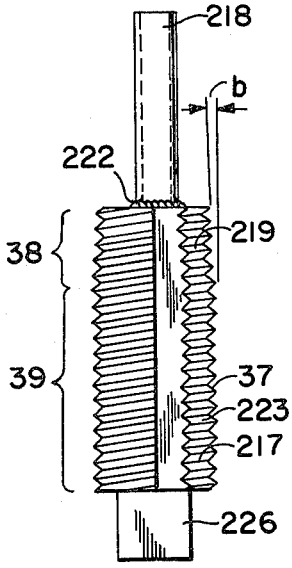
FIG. 6 is an enlarged detail view like FIG. 3 of a modified connector member in which the threaded portion is partially tapered and partially cylindrical.

Referring to FIG. 6, a modified connector member 37 is shown in which the plug 219 has self-tapping threads 223 with a partially tapered lead portion 38 and a cylindrical trailing portion 39. The self-tapping threads 223 on the tapered portion 38 have a taper shown as angle "b" which is approximately 3°. In all other respects, the connector member 217 is like the connector member of the embodiment shown in FIG. 3 with an anti-rotation head 226 and with the sleeve 218 secured to the plug or body as by brazing or soldering at joint 222. The configuration of the connector ensures against overtightening. The extent of penetration into the reduced diameter bore may be controlled, rather than by a torque reading, by the number of relative revolutions. This embodiment would normally be employed only where the I.D. of the reduced diameter bore can closely be controlled with confidence at the shoulder.

Figure 4:
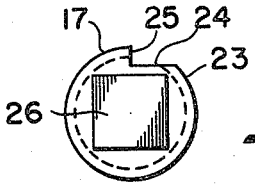
FIG. 4 is an end view of the connector member taken from the plane of line 4—4 in FIG. 3.

Referring to FIGS. 7, 9, 10 and 11, another modification is shown which is similar to the anode 14 of FIGS. 2, 3 and 4, and the anode 36 of FIG. 5. In this particular embodiment, the anode body 310 has a bore 311 which does not extend through the body from the first end 312 to the second end 313 but terminates in a reduced diameter section 315 near the center. The bore of section 315 may be drilled first and the enlarged portion may be formed by a reaming operation. The reduced diameter portion 315 of the bore 311 has a smaller diameter "d" than the diameter D of the enlarged portion so that the connector member 317, which has a plug 319 with self-tapping threads 323, may be inserted through the enlarged portion and into engagement with the surface of the reduced diameter portion 315 at the shoulder 320 for cutting threads in that surface.

Figure 10:
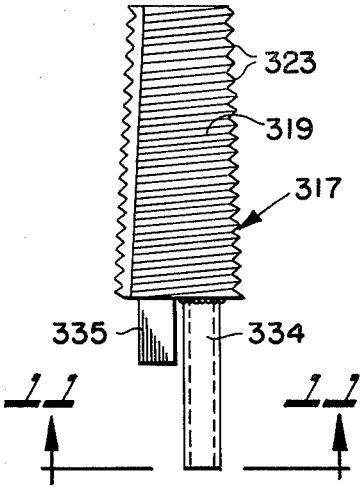
FIG. 10 is an enlarged detail view of the connector member shown in FIG. 9 as seen from the line 10—10 thereof.
Figure 11:
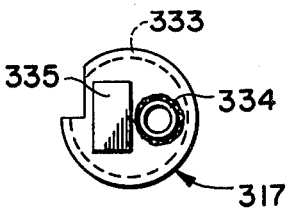
FIG. 11 is an end view of the connector member shown in FIG. 10 taken from the line 11—11 in FIG. 10.

A sleeve 334 is mounted on the end of the plug 319 with an anti-rotation head 35 alongside but offset from the sleeve as shown in FIGS. 10 and 11. The lead wire 327 extends through the enlarged portion 332 and into the sleeve 334 which is crimped to the lead wire before insertion and tapping to provide the necessary contact. In the assembly of this anode 42, the connector member 317 is inserted in the second end 313 and through the enlarged portion of the bore with the plug 319 entering the reduced diameter portion 315 of the bore 311 at the shoulder 320. The head 335 is gripped to prevent turning of the connector member 317 and the body of the anode 310 is rotated to cut threads in the surface of the reduced diameter portion 315 of the bore to provide a strong tight connection. Following this, a sealant 329 is inserted or poured through the second end 313 into the enlarged portion of the bore 311 to surround the exposed end of the connector member 317 and lead wire 327.

Figure 8:
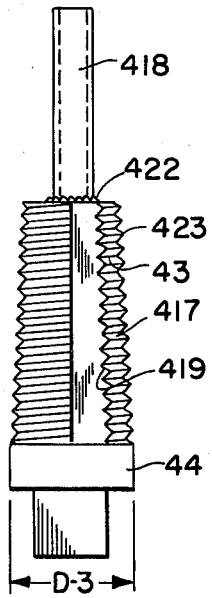
FIG. 8 is an enlarged detail view like FIG. 3 of a modified connector member in which the threaded plug has a non-threaded section.

Referring now to FIG. 8, a modified connector member 43 is shown having a sleeve 418 and a plug 419 secured together by soldering or brazing at joint 422 and self-tapping threads 423. This connector member 43 is similar to the connector member 17 of FIG. 3 except a non-threaded cylindrical portion 44 is provided at the larger end of the tapered plug 419. The non-threaded cylindrical portion 44 has a diameter D3 equal to the maximum diameter of the tapered threads 423 so that when the connector member 43 is moved into engagement with the reduced diameter or intermediate portion 16 of the bore 11 as shown in FIG. 2 and relatively rotated with respect to the anode body 10, the extent of rotation and the length of the threads cut in the surface of the intermediate portion is limited by the cylindrical portion. In this way, the operator will know when the desired threads are cut by the sudden resistance of the cylindrical portion 44 to rotation of the connector member 417 and anode body 10.

Figure 7:
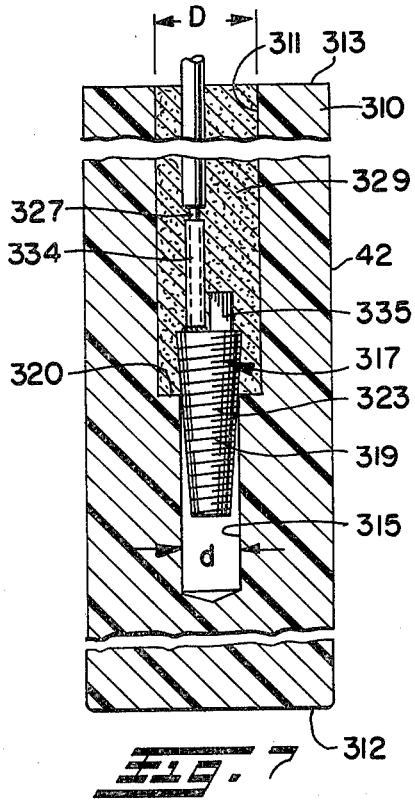
FIG. 7 is a longitudinal section like FIG. 2 of a modification in which the bore does not extend completely through the anode.
Figure 9:
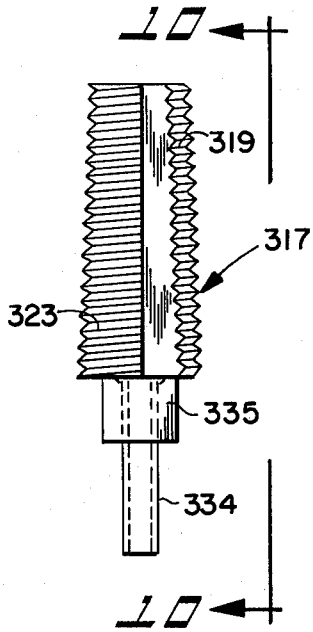
FIG. 9 is an enlarged detail view of a modified connector member of the type seen in FIG. 7.

With reference to FIGS. 9–11, the modification shown is the same plug as shown in FIG. 7 in which a connector member 317 has a plug 319 connected to sleeve 334. An anti-rotation head 335 is formed on the plug but offset from the sleeve 334. The driving tool engaging the anti-rotation head 335 may be cut away on one side for clearance of the crimp sleeve 334 and the wire lead connected thereto. In any event the embodiments of FIGS. 5, 7 and 9–11 permit the lead wire to extend from one or both ends of the anode for connection to a power supply or series connection with other anodes and a power supply, as shown when comparing FIGS. 7 and 4, respectively. FIGS. 9 and 11 also illustrate clearly the chip clearance channel and cutting edge of the self-tapping plug.

Although the illustrated embodiments of the present invention illustrate the crimp sleeve to be brazed or soldered to the plug, it will be appreciated that the material of the plug may be sufficiently malleable so that a hollow nose probe may be integrally formed in the plug into which the anode lead wires may be inserted and mechanically crimped.

Also, while several forms of self-tapping plug are illustrated, the preferred form is the continuous uniform taper of FIGS. 2–4, 5, 7 and 9–11, particularly when extruded hole anode material is employed. Such continuous taper plug has the ability to accommodate a number of inside diameters in the minor orifice bore. With an extruded hole, the diameter may change as the extrusion die wears and is changed. Such tapered thread allows accommodation to a substantial variation in the I.D. of the minor orifice bore.

Also, it should be noted that the deeper the plug cuts into the anode, the greater the torque required relatively to turn the plug or anode. The amount of torque required directly inversely affects and thus becomes a measure of the electrical contact resistance of the connector to the anode. Therefore at a certain minimum torque, there will be assured a connector-to-anode resistance well below conventional connections. Thus the predetermined torque achieves both an excellent electrical connection and also avoids fractures or stress in the system.

Further, while it will be appreciated that the self-tapping feature of the present invention greatly facilitates the connection deep into the anode, it should also be apparent that such self-tapping feature can be employed anywhere along the bore and much nearer an end than at the center. If the connector is tapped into the end of the anode, even though higher torque is usually required, the reaming or counter bore operation may be avoided. An anode connection near the end, although not providing an anode with the longest possible service life, is obviously less expensive to manufacture.

While certain representative embodiments and details have been shown for the purpose of illustrating the invention, it will be apparent to those skilled in the art that various changes and modifications may be made therein without departing from the invention.

The embodiments of the invention in which an exclusive property or privilege is claimed are defined as follows:

1. A method of making a cathodic protection anode comprising the steps of extruding the anodic material into a continuous elongate body having an extruded hole extending entirely through the elongate axis thereof from one end of the anodic material to the other, and securing an electrical connector in the extruded hole on such elongate axis with an electrical lead connected to such connector, and then filling the hole with sealant.

2. A method as set forth in claim 1, wherein said electrical connector includes a self-tapping thread and is secured in such hole by relatively rotating the extruded anodic material and the electrical connector.

3. A method as set forth in claim 2 including the step of providing the connector with an anti-rotation surface by which it may be rotated or held against rotation exteriorly of the hole.

4. A method as set forth in claim 3 including the step of providing the electrical connector with an electrical lead adjacent to but offset from the anti-rotation surface to avoid interference with the lead connected thereto when the connector is rotated or held against rotation.

5. A method as set forth in claim 3, wherein the step of relatively rotating is obtained by holding the connector against rotation and rotating the anodic extrusion.

6. A method as set forth in claim 2 including applying a predetermined torque to the connector during self-tapping both to limit the extent of tapping and to ensure the desired conductivity between the connector and anodic material.

7. A method as set forth in claim 1, wherein the connector is secured into the extruded hole at the approximate mid-point between the ends of the anode.

8. An anode for cathodic protection systems comprising an elongated extruded one piece body of anode material having an extruded hole completely through the elongate axis thereof and having first and second axial ends, said extruded hole being formed with an enlarged diameter between said first and second axial ends forming a shoulder in said hole, an electrical connection in said hole seated in and secured against said shoulder on said elongate axis, an anode lead wire secured to said electrical connection and extending from said connection through said hole through at least one of said axial ends, and a sealant in said hole surrounding said connection and lead wire.

9. An anode as set forth in claim 8, wherein said shoulder and electrical connection are approximately midway between said axial ends in the center of said anode.

10. An anode as set forth in claim 9, wherein said shoulder forms an axial interference with said connection holding the same against axial displacement in one direction.

11. An anode as set forth in claim 10, including means forming an interference between said connection and bore holding said connection against axial displacement in both directions.

12. A method of making an anode for a cathodic protection system comprising the steps of extruding an elongated one piece body of anode material with an extruded hole completely through the elongate axis thereof from one axial end to the other, forming an enlarged diameter in such hole to form a shoulder between such one and such other axial end, forming an electrical connection in such hole seated in such enlarged diameter and secured against such shoulder with an anode lead wire secured thereto and extending from such connection through such hole and through such one axial end, and sealing such hole to enclose both such connection and lead wire within the anode.

13. A method as set forth in claim 12, wherein such shoulder is formed approximately equidistant such one and other axial ends to be in substantially the center of the anode.

14. A method as set forth in claim 13, wherein such shoulder is formed by relatively rotating such extruded anode material and a cutting tool.

15. A method as set forth in claim 14, including the step of mechanically securing such connection with such shoulder to hold the same against axial displacement in either direction.

16. A method as set forth in claim 12, including the step of utilizing such hole from the shoulder to the other axial end to secure such connection in place.

17. An anode for a cathodic protection system comprising an elongated body of anode material having spaced-apart first and second ends and a bore extending at least partially through said body from said first end to a position between said first and second ends, wherein said bore has a portion having an enlarged diameter extending from said first end to a shoulder in said bore, and a portion having a smaller diameter extending beyond said shoulder, a connector member inserted in said bore and having a self-tapping thread for cutting a thread in the surface of said smaller diameter portion of said bore upon relative rotation of said connector member and elongated body, an anode lead wire fastened to said connector member and extending from at least one of said ends, and a sealant in said bore surrounding said connector.

18. An anode in accordance with claim 17, wherein said connector member has a maximum diameter less than said enlarged diameter and greater than said smaller diameter, and a diameter at its first inserted end smaller than said smaller bore diameter, wherein said self-tapping thread is on a tapered surface of the connector member, for cutting said thread in the surface of said smaller diameter of said bore at said shoulder.

19. An anode in accordance with claim 17, having means for resisting turning comprising anti-rotation surfaces on said connector member engageable by a tool during assembly.

20. An anode in accordance with claim 17, wherein said connector member comprises a plug member having said lead wire extending into and being fastened to the sleeve member.

21. An anode in accordance with claim 17, wherein said sealant is supplied to said bore through at least one of said ends of said elongated body.

22. An anode in accordance with claim 17, wherein said position is roughly half-way between said first and second ends.

23. An anode in accordance with claim 18, wherein said elongated body is extruded, and is reamed from said first end to provide said enlarged diameter portion of said bore and shoulder.

24. An anode in accordance with claim 18, wherein said thread is cut into said surface of said smaller diameter portion of said bore to a predetermined extent determined by a predetermined torque applied relatively to rotate said anode and said connector member.

25. An anode in accordance with claim 18, wherein said self-tapping thread extends over a portion of said connector member and terminates in a non-threaded cylindrical portion limiting the extent of the thread cut into said surface of said smaller diameter portion of said bore.

26. An anode in accordance with claim 18, wherein said connector member has a truncated cone shape.

27. An anode in accordance with claim 18, wherein said connector member has a flute and cutting face extending in and along the length of the exterior surface of the connector member.

28. An anode in accordance with claim 19, wherein said bore extends the entire length of said elongated body.

29. An anode in accordance with claim 20, wherein said lead wire is fastened to said sleeve member by crimping on said lead wire.

30. An anode in accordance with claim 20, wherein said sleeve member is fastened to said plug member.

31. An anode in accordance with claim 23, wherein said anode material is graphite.

32. An anode in accordance with claim 25, wherein said truncated cone includes a coaxial cylinder of equal diameter as, and connecting to, the largest base of the truncated cone.

33. An anode in accordance with claim 28, wherein said anti-rotation surfaces are in the form of a projection on the end of said connector member opposite that to which the lead wire is fastened.

34. An anode in accordance with claim 33, including a second lead wire connected to and extending from the end of said connector member having said projection, and offset from said projection.

35. A method of making an anode for a cathodic protection system comprising forming an elongated body of anode material having spaced-apart first and second ends and a bore extending at least partially through said body from said first end to a position between said first and second ends, wherein said bore is formed having an enlarged diameter extending from said first end to a shoulder in said bore, and a portion having a smaller diameter extending beyond said shoulder, connecting a lead wire to a connector member with a self-tapping thread into engagement with the surface of said smaller diameter portion of said bore, relatively rotating said body of anode material and said connector member to cut threads in said surface of said bore, and inserting sealant in said bore surrounding said connector member.

36. A method of making an anode in accordance with claim 35, wherein said connector member is formed having a maximum diameter less than said enlarged diameter and greater than said smaller diameter, and a diameter at its first inserted end smaller than said smaller bore diameter, wherein said self-tapping thread is formed on a tapered surface of the connector member, for cutting said thread in the surface of said smaller diameter of said bore at said shoulder.

37. The method of claim 35, further comprising the step of reaming said bore from said first end to said intermediate portion to provide an enlarged portion, and moving said connector member into said enlarged portion of said bore and said self-tapping thread into engagement with the surface of said bore in said intermediate portion.

38. The method of claim 35, wherein said elongated body is extruded in a tubular form.

39. The method of claim 37, wherein said self-tapping threads are tapered to increase the resistance to relative rotation of said connector member and anode body as said thread is cut in said bore.

40. The method of claim 35, wherein said connector member includes a projecting sleeve, said lead wire being fastened to said connector member by crimping said sleeve on said lead wire.

41. The method of claim 35, wherein during said rotation of said body of anode material relative to said connector member, said connector member is held stationary while said body of anode material is rotated.

42. The method of claim 37, wherein said rotation of said body of anode material relative to said connector member is continued until the torque required reaches a predetermined amount at which the desired predetermined amount of thread is cut into said bore.

43. The method of claim 37, wherein said self-tapping thread extends over a first portion of said connector member and terminates in a second non-threaded portion and said body of anode material is rotated relative to said connector member until said first portion of said connector member is threaded into said bore and said second non-threaded portion engages said cut thread providing a limit to said thread cut into said bore.

44. A method of making a cathodic protection anode comprising the steps of extruding the anodic material into a continuous elongate body having a hole through the elongate axis thereof, securing an electrical connector into the extruded hole therethrough with an electrical lead already connected to such connector, and then filling the hole with sealants, said electrical connector including a self-tapping thread which is secured in such hole by relatively rotating the extruded anodic material and the electrical connector, and including the step of providing a shoulder in such hole into which the connector is tapped.

45. A method as set forth in claim 44, including the step of providing the connector with an anti-rotation surface by which it may be rotated or held against rotation.

46. A method as set forth in claim 45, including the step of providing the electrical connector with an electrical lead adjacent to but offset from the anti-rotation surface to avoid interference with the lead connected thereto when the connector is rotated or held against rotation.

47. A method as set forth in claim 45, wherein the step of relatively rotating is obtained by holding the connector against rotation and rotating the anodic extrusion.

48. A method as set forth in claim 44, wherein such shoulder is provided by reaming the extruded hole from one end of the extruded anodic material.

49. A method as set forth in claim 44, including applying a predetermined torque to the connector during self-tapping both to limit the extent of tapping to ensure the desired conductivity between the connector and anodic material.

50. A method as set forth in claim 44, wherein the connector is secured to the extruded hole at the approximate center of the anode.

51. A method of making a cathodic protection anode comprising the steps of extruding the anodic material into a continuous elongate body having a hole through the elongate axis thereof, securing an electrical connector into the extruded hole therethrough with an electrical lead already connected to such connector, and then filling the hole with sealant, the electrical connector including a self-tapping thread and being secured in such hole by relatively rotating the extruded anodic material and the electrical connector, and including the step of providing a shoulder in such hole into which the connector is tapped.

52. A method as set forth in claim 51, wherein such shoulder is provided by reaming the extruded hole from one end of the extruded anodic material.

* * * * *